US007316391B2

(12) United States Patent
Stemmle

(10) Patent No.: US 7,316,391 B2
(45) Date of Patent: Jan. 8, 2008

(54) AUTOMATED PAPER STACK CONDITIONING

(75) Inventor: Denis J. Stemmle, Stratford, CT (US)

(73) Assignee: Pitney Bowes Inc., Stamford, CT (US)

( * ) Notice: Subject to any disclaimer, the term of this patent is extended or adjusted under 35 U.S.C. 154(b) by 521 days.

(21) Appl. No.: 10/862,682

(22) Filed: Jun. 7, 2004

(65) Prior Publication Data

US 2005/0269763 A1 Dec. 8, 2005

(51) Int. Cl.
*B65H 1/00* (2006.01)

(52) U.S. Cl. ..... 271/161; 271/148

(58) Field of Classification Search ..... 271/145, 271/161, 148; 399/377, 393
See application file for complete search history.

(56) References Cited

U.S. PATENT DOCUMENTS 1,419,733 A * 6/1922 Hitchcock ..... 271/126
3,720,407 A * 3/1973 Woodward ..... 271/161
5,137,174 A * 8/1992 Bell ..... 271/161
5,177,544 A * 1/1993 Kimura et al. ..... 399/16
6,428,000 B1 * 8/2002 Hara et al. ..... 271/223
6,612,561 B2 * 9/2003 Sekine ..... 271/3.14
6,629,693 B2 * 10/2003 Siow et al. ..... 271/171

* cited by examiner

*Primary Examiner*—Patrick Mackey
*Assistant Examiner*—Michael C McCullough
(74) *Attorney, Agent, or Firm*—Ronald Reichman; Angelo N. Chaclas

(57) ABSTRACT

A paper handling apparatus includes a tray for supporting a stack of cut paper sheets. The tray includes at least one hinged portion. A feed roller is disposed above the tray for selectively feeding sheets seriatim from the stack of cut paper sheets. The paper handling apparatus further includes a stack flexing mechanism for pivoting the hinged portion of the tray to flex the stack of paper without bringing the paper into contact with the feed roller. This conditioning of the paper stack may reduce misfeeds or multifeeds from the paper stack.

13 Claims, 11 Drawing Sheets

AUTOMATED PAPER STACK CONDITIONING

BACKGROUND OF PRIOR ART

This invention relates generally to paper handling equipment, and more particularly to equipment which feeds cut paper sheets from stacks of such sheets.

In equipment that feeds cut paper sheets from stacks of sheets, it is not unusual for the cut sheets to be misfed or for more than one sheet to be fed at one time ("multifeed"). In either case, such an occurrence may result in jamming or other faulty operation of the equipment.

The purpose for a paper feeder is to feed a single sheet of paper from a stack and to leave all other sheets remaining in the stack. To insure that at least one sheet is fed, the drive force on top of the sheet must exceed the retarding force elsewhere on the sheet. To prevent more than one sheet from feeding, the retarding forces on all sheets below the top sheet must be higher than the drag force exerted on the second sheet by the first sheet as it is being fed. For these reasons, the forces between sheets in a stack affect the performance of a feeder.

A number of factors may increase the likelihood of a misfeed or multifeed. One factor is the presence of so-called "edge welds" in the stack of cut paper sheets from which feeding is to be performed. Edge welds may occur during the paper manufacturing process during the step of cutting reams of paper prior to wrapping the reams. Large sheets of paper may be assembled into relatively large stacks of typically 500 sheets and then cut to a standard size such as letter size using a guillotine cutter. If the blade of the cutter is less than optimally sharp, individual sheets in the stack may be slightly bent downward at the edges as cutting takes place. The bending of the sheets at the edges may occur under very high local pressure, so that the edges of two or more sheets may be temporarily affixed to one another.

Another factor that may cause misfeeds or multifeeds is bonding between sheets other than at the edges. Such bonding may result during storage and transportation of wrapped reams of paper. For example, ten reams are commonly packed in a carton, and a considerable number of cartons may be stacked up during shipment and/or storage. The resulting load on the reams of the lower cartons in the stack of cartons may amount to hundreds of pounds. This loading may tend to press air out from between adjacent sheets in the reams and may lead individual paper fibers in neighboring sheets to interlock with each other. Both of these effects tend to form a bond between the surface of one sheet and the surface of a neighboring sheet. These bonds may cause the forces between adjacent sheets in a stack to be substantially higher than ordinary sheet-to-sheet friction and thereby cause misfeeds and/or multifeeds.

A third factor which may contribute to multifeeds arises from interfaces between reams in a stack of cut paper sheets. When a stack of paper in a paper tray is partially depleted, it is not unusual for an operator of the paper handling equipment to replenish the paper supply by adding additional paper to the top of the stack. This may occur when the stack is nearly completely depleted. The sheets within the original stack of sheets, as well as the sheets within the added stack, may have relatively high sheet-to-sheet coefficients of friction due to the edge welding and sheet-to-sheet bonding factors described in the previous two paragraphs. However, the coefficient of friction between the top sheet of the original stack and the bottom sheet of the added stack may be much lower than for the sheets above and below this interface. This is because the two sheets at the interface were not cut together or packed together so that there is little intermeshing of fibers. Also, when the operator adds new paper to the stack, a partial layer of air may be trapped between the new and old stacks at the interface.

Given such an interface, a problem may arise when the sheet feeder has fed most of the newly added sheets and then attempts to feed one of the few remaining sheets above the ream interface. In particular, the combination of high sheet-to-sheet friction for the few sheets above the interface and the relatively low sheet-to-sheet friction at the interface creates a relatively high probability that several sheets will be fed simultaneously. In other words, the singulation function of the feeder is more likely to fail at the ream interface by feeding more than one sheet just above the ream interface.

Still another factor that may lead to misfeeds and/or multifeeds may be present in stacks of pre-printed sheets, in which the ink printed on the sheets may tend to produce a mild adhesive effect between adjacent sheets.

It is a common practice for skilled operators of paper handling equipment to bend or fan a ream of paper before loading in order to break edge welds, break the bonds between interlocked fibers, and add a layer of air between adjacent sheets of a ream. Such conditioning of the ream may reduce sheet-to-sheet friction between the sheets in the ream, thereby reducing the chance of misfeeds and/or multifeeds. However, many operators are not aware of the desirability of bending or fanning a ream of paper before loading, and fail to do so. Also, some operators may have relatively small hands, and so may not be able to easily handle a ream in order to condition the ream before loading in a paper tray.

SUMMARY

Accordingly, methods and apparatus are provided to reduce the likelihood of misfeeds and/or multifeeds when feeding cut paper sheets from a paper tray.

In one aspect, a method includes supporting a stack of cut paper sheets on a tray that includes a hinged portion. The method further includes pivoting the hinged portion of the tray to flex the stack of cut paper sheets without bringing the stack of cut paper sheets in contact with a feed member.

The pivoting may include pivoting the hinged portion of the tray downwardly so that a first portion of the stack of cut paper sheets is moved to an elevation that is below an elevation of the first portion of the stack of cut paper sheets prior to the pivoting. The pivoting may include contacting a top sheet of the stack with a first engagement member and moving the first engagement member downwardly to apply a downward force to the hinged portion of the tray via the stack of cut paper sheets to move the hinged portion of the tray downwardly from an initial position of the hinged portion of the tray. The downward pivoting of the hinged portion of the tray may be performed against an upward force applied by a spring to the hinged portion of the tray.

The method may further include contacting the top sheet of the stack of cut paper sheets with a second engagement member at an opposite portion of the stack from the first engagement member while the hinged portion of the tray is downwardly inclined relative to the initial position of the hinged portion of the tray. The method may further include allowing the hinged portion of the tray to return to the initial position while the second engagement member is in contact with the top sheet of the stack. The method may further include moving the second engagement member upwardly away from the stack of cut paper sheets after the hinged portion of the tray has returned to the initial position.

The tray may include a first hinged portion and a second hinged portion, with a first portion of the stack of cut paper sheets supported on the first hinged portion of the tray and a second portion of the stack supported on the second hinged portion of the tray. In such a case, the pivoting may include upwardly pivoting the first and second hinged portions of the tray to raise the first and second portions of the stack above their elevations in respective home positions in which the first and second hinged portions are in alignment with each other and/or downwardly pivoting the first and second hinged portions to lower the first and second portions of the stack below their elevations in respective home positions in which the first and second hinged portions are in alignment with each other.

In another aspect, a method includes supporting a stack of cut paper sheets on a tray, where the tray includes a hinged portion. The method also includes pivoting the hinged portion downwardly to flex the stack of cut paper sheets.

The pivoting may move a first portion of the stack of cut paper sheets to a second elevation below a first elevation of the first portion of the stack of cut paper sheets. The pivoting may include contacting a top sheet of the stack of cut paper sheets with an engagement member and moving the engagement member downwardly to apply a downward force to the hinged portion of the tray via the stack of cut paper sheets.

In still another aspect, a method includes supporting a stack of cut paper sheets on a tray, where the tray includes a first hinged portion and a second hinged portion, with a first portion of the stack of cut paper sheets supported on the first hinged portion of the tray and a second portion of the stack supported on the second hinged portion of the tray. The method also includes pivoting both hinged portions of the tray to flex the stack of cut paper sheets.

In yet another aspect, an apparatus includes a tray for supporting a stack of cut paper sheets. The tray includes a hinged portion. The apparatus also includes a feed mechanism disposed above the tray for selectively feeding sheets seriatim from the stack of cut paper sheets. The apparatus further includes a stack flexing mechanism for pivoting the hinged portion of the tray to flex the stack of cut paper sheets without bringing the stack of cut paper sheets in contact with the feed mechanism.

The stack flexing mechanism may include a mechanism for downwardly pivoting the hinged portion of the tray. The stack flexing mechanism may include a mechanism for inclining the hinged portion of the tray downwardly from a hinge point of the tray.

The stack flexing mechanism may include a first engagement member disposed above a first end of the tray for selectively contacting a top sheet of the stack of cut paper sheets to apply a downward force to the hinged portion of the tray via the stack of cut paper sheets. The apparatus may include a bias mechanism for upwardly biasing the hinged portion of the tray. The apparatus may also include a second engagement member disposed above a second portion of the tray, where the second portion is opposite the first portion of the tray. The second engagement member may be for selectively contacting the top sheet of the stack of cut paper sheets.

The apparatus may further include a control device operatively coupled to the first and second engagement members to:

move the first engagement member downwardly from a first position to a second position at a time when the second engagement member is not in contact with the top sheet of the stack of cut paper sheets;

move the second engagement member downwardly from a first position to a second position at a time when the first engagement member is in contact with the top sheet of the stack of cut paper sheets;

move the first engagement member upwardly from the second position of the first engagement member to the first position of the first engagement member at a time when the second engagement member is in contact with the top sheet of the stack of cut paper sheets; and move the second engagement member upwardly from the second position of the second engagement member to the first position of the second engagement member at a time when the first engagement member is not in contact with the top sheet of the stack of cut paper sheets.

The tray may include a first hinged portion for supporting a first portion of the stack of cut paper sheets and a second hinged portion for supporting a second portion of the stack of cut paper sheets. The apparatus may also include a mechanism for upwardly pivoting the first and second hinged portions of the tray to respective elevations that are higher than their elevations in respective home positions in which the first and second hinged portions are in alignment with each other and/or a mechanism for downwardly pivoting the first and second hinged portions of the tray to respective elevations that are lower than their elevations in respective home positions in which the first and second hinged portions are in alignment with each other.

In still a further aspect, an apparatus includes a tray for supporting a stack of cut paper sheets. The tray includes a hinged portion that is pivotable about a hinge point. The apparatus also includes a stack flexing mechanism for downwardly pivoting the hinged portion of the tray so that an end of the hinged portion is at an elevation lower than its elevation in a home position in which the hinged portion is in alignment with another portion of the tray.

The stack flexing mechanism may include an engagement member disposed above the hinged portion of the tray, and a mechanism for downwardly moving the engagement member to contact a top sheet of the stack of cut paper sheets to apply a downward force to the hinged portion of the tray via the stack of cut paper sheets. The apparatus may further include a bias mechanism for upwardly biasing the hinged portion of the tray toward a horizontal position.

In yet a further aspect, an apparatus includes a tray that includes a first hinged portion to support a first portion of a stack of cut paper sheets and a second hinged portion to support a second portion of the stack of cut paper sheets. The apparatus also includes a stack flexing mechanism for selectively pivoting the first and second hinged portions of the tray.

At least one of the hinged portions of the tray is pivotable about a hinge point, and the stack flexing mechanism may include a mechanism for selectively upwardly pivoting the hinged portions to respective elevations that are higher than their elevations when in a home position in which the first and second hinged portions are in alignment with each other and/or a mechanism for selectively downwardly pivoting the hinged portions to respective elevations that are lower than their elevations when in a home position in which the first and second hinged portions are in alignment with each other.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description, and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

The present invention includes a mechanism that bends or flexes a paper stack while it is in a paper tray. The flexing of the paper stack "conditions" it by, e.g., breaking edge welds between sheets of the stack, adding a layer of air between sheets of the stack, and/or separating paper fiber and/or adhesive ink bonds between sheets. Thus the conditioning of the paper stack may generally reduce sheet-to-sheet drag forces between sheets in the paper stack or make the drag forces more uniform to reduce misfeeding or multifeeding of sheets from the paper tray.

Figure 1:
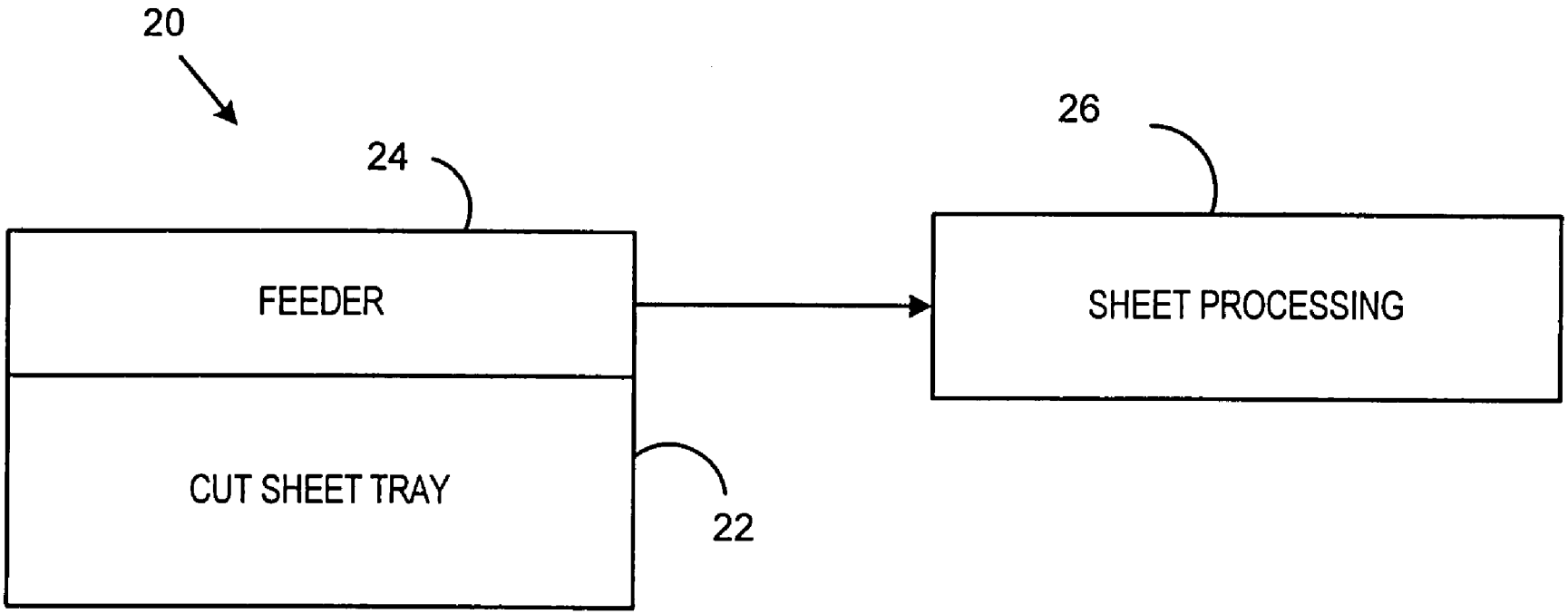
FIG. 1 is a schematic block diagram of a paper handling apparatus provided according to the invention.

Referring now to the drawings, and particularly to FIG. 1, the reference numeral 20 indicates generally an apparatus that includes a paper tray 22 from which a feeder 24 feeds individual cut paper sheets to a sheet processing mechanism 26. The sheet processing mechanism may be, for example, a print mechanism (e.g., for laser or ink jet printing) or other mechanism that forms an image on sheets fed seriatim from the tray 22 by the feeder 24. Thus the apparatus may be a computer printer, copier, fax machine or combination thereof. In other embodiments the sheet processing mechanism 26 may fold each sheet fed from the tray 22 and may insert the folded sheet in an envelope as part of an automated mail processing system. Alternatively, the sheet processing mechanism may insert each sheet in an envelope without folding the sheet. Thus the apparatus may be folder/inserter or the like.

Figure 2:
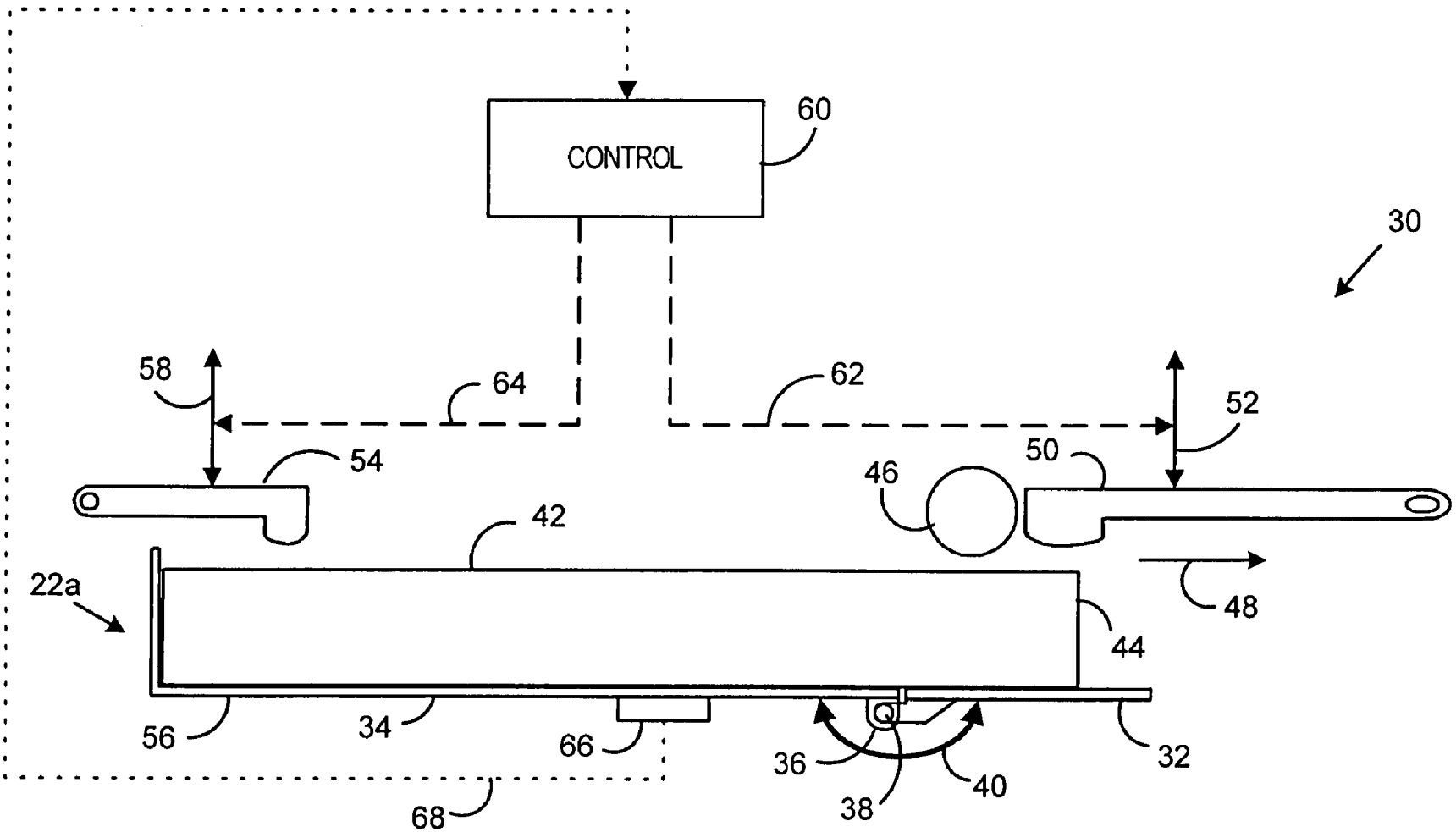
FIG. 2 is a schematic side view of a paper tray and associated paper stack flexing mechanism that are part of the apparatus of FIG. 1 in accordance with some embodiments of the invention.

FIG. 2 is a schematic side view of a paper tray 22*a* which is an exemplary embodiment of the paper tray 22 of FIG. 1. FIG. 2 also shows a stack flexing mechanism 30 associated with the paper tray 22*a*. It will be observed that the paper tray 22*a* includes a hinged portion 32 which constitutes the downstream end of the tray 22*a*. (As used herein, "downstream" means the direction in which sheets are fed from the tray and "upstream" means the opposite direction from downstream.) The hinged portion 32 is pivotably connected to the main body 34 of the tray 22*a* via a hinge 36 and is pivotable about a hinge point 38 that coincides with the hinge 36. A bias mechanism, such as a torsion spring schematically represented at 40, biases the hinged portion 32 of the tray 22*a* in an upward direction to a home position (which in this example is horizontal). The upward travel of the hinged portion 32 of the tray 22*a* may be limited to the horizontal position shown in FIG. 2 by a stop which is not shown. A stack 42 of cut paper sheets (e.g., a ream of copier or printer paper) is shown supported in the tray 22*a* with a downstream end 44 of the stack 42 supported by the hinged portion 32 of the tray 22*a*. A feed roller 46 (which is part of the feeder 24 schematically shown in FIG. 1) is disposed above the hinged portion 32 of the tray 22*a*. The feeder may also include a mechanism which is not shown to selectively lower the feed roller 36 to bring the feed roller 46 into contact with the top sheet (not separately shown) of the stack 42, and the feeder may rotate the feed roller 46 to feed the top sheet in a downstream direction indicated by arrow 48. (In an alternative embodiment, the tray 22*a* may be raised to bring the top sheet of the stack into contact with the feed roller.) It will be appreciated that other elements are conventionally used in feeders such as nudger rollers, separator rollers, retard elements (which might be pads, rollers or belts), snubber assemblies, etc. All of these various types of feed elements are intended to be represented by feed roller 46 in the drawings, and may be referred to as "feed members".

The stack flexing mechanism includes a first (downstream) engagement member 50 which is disposed above the hinged portion 32 of the tray 22*a*. A first actuator 52 is operatively coupled to the first engagement member 50 to selectively move the first engagement member up and down, in a manner to be described below, to selectively bring the first engagement member 50 in contact with the top sheet of the stack 42. The first actuator, which is schematically represented at 52, for example, may be constituted by a suitable motor and cam arrangement or by a solenoid. It may be preferable to use a cam and motor as such an arrangement may be more reliable than a solenoid, particularly in view of the presence of paper dust in the apparatus which may adversely affect a solenoid over time.

The stack flexing mechanism also includes a second (upstream) engagement member 54 disposed above the upstream end 56 of the tray 22*a*. (The upstream end 56 of the tray 22*a* is opposite to the hinged portion 32 which constitutes the downstream end of the tray 22*a*.) A second actuator schematically represented at 58 is operatively coupled to the second engagement member 54 to selectively move the second engagement member up and down, in a manner to be described below, to selectively bring the second engagement member in contact with the top sheet of the stack 42. The second actuator 58 may also be constituted for example by a suitable motor and cam arrangement or by a solenoid. Again a motor and cam may be preferable from the point of view of reliability.

A control device 60 (e.g., an electronic controller, microcontroller and/or microprocessor, which may perform other control functions for the apparatus besides those described herein) is also included in the stack flexing mechanism 30. The control device is operatively coupled, via first and second control signal paths 62, 64, respectively, to the actuators 52, 58 to control operation of the actuators 52, 58.

Thus the control device 60 is also operatively coupled to the engagement members 50, 54 to control movement thereof. (The control signal paths may include suitable buffers, driver circuitry, etc., which are not separately shown.)

A sensor 66 is associated with the tray 22*a* (though not necessarily positioned as indicated in the drawing) to detect occasions on which paper is loaded into the tray 22*a*. The sensor may be, for example, an optical or pressure-sensitive sensor. In addition or alternatively, the sensor may be able to detect closing of the tray 22*a* (or of a door—not shown—giving access thereto) after the tray or door has been opened to give an operator access to the tray. In any case, the sensor 66 is operatively coupled to the control device 60 via a sensor signal path 68 so that the sensor 66 can indicate to the control device 60 occurrence of an event in which paper has, or may have, been loaded into the tray.

Figure 3:
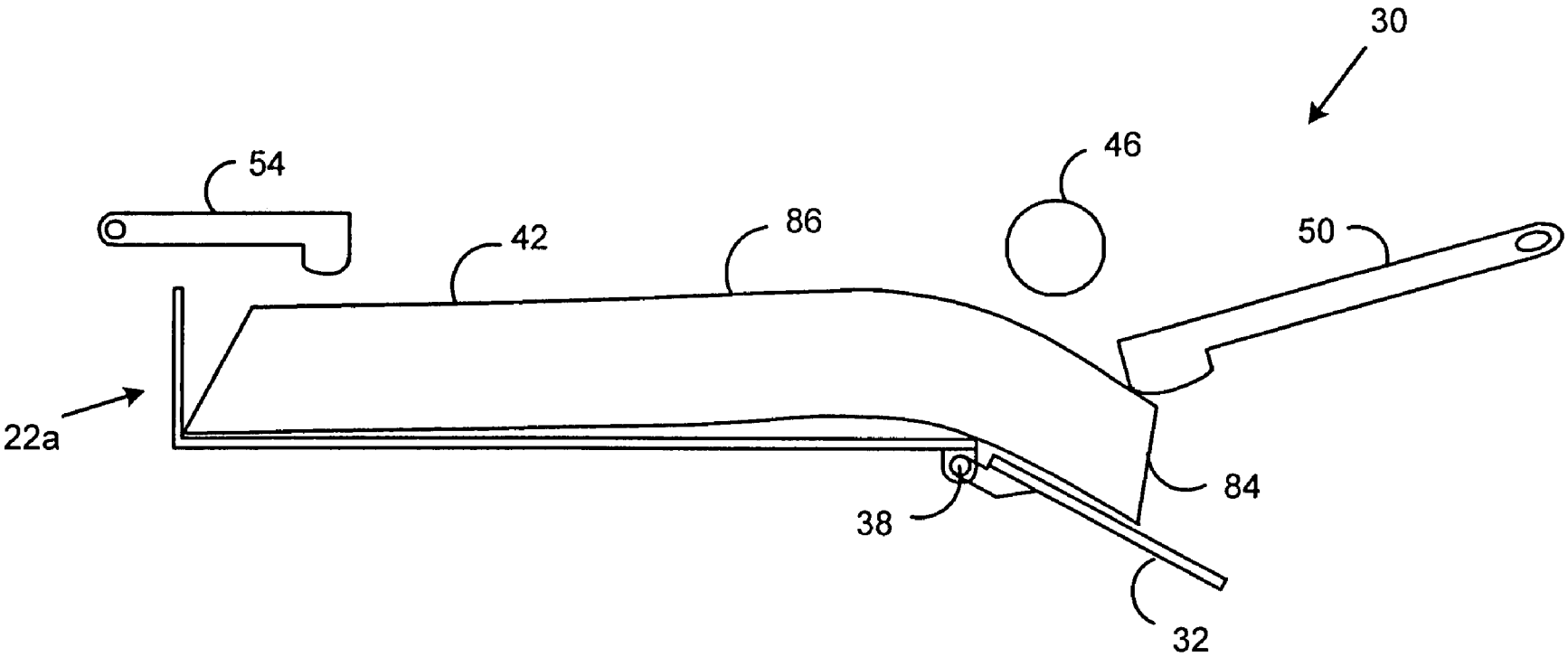
FIGS. 3-6 are simplified schematic side views of the paper stack flexing mechanism of FIG. 2, showing various stages of operation thereof.
Figure 5:
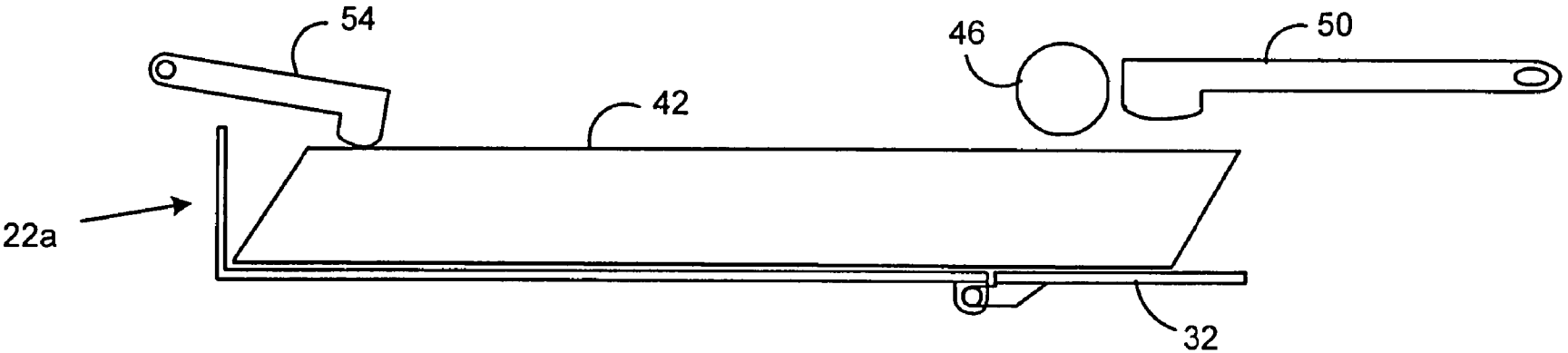
Figure 6:
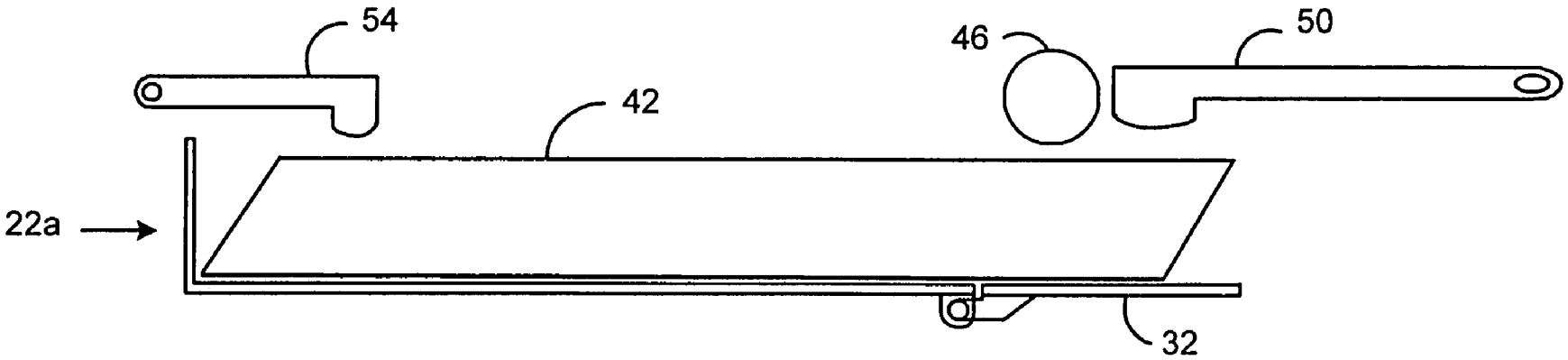
Figure 7:
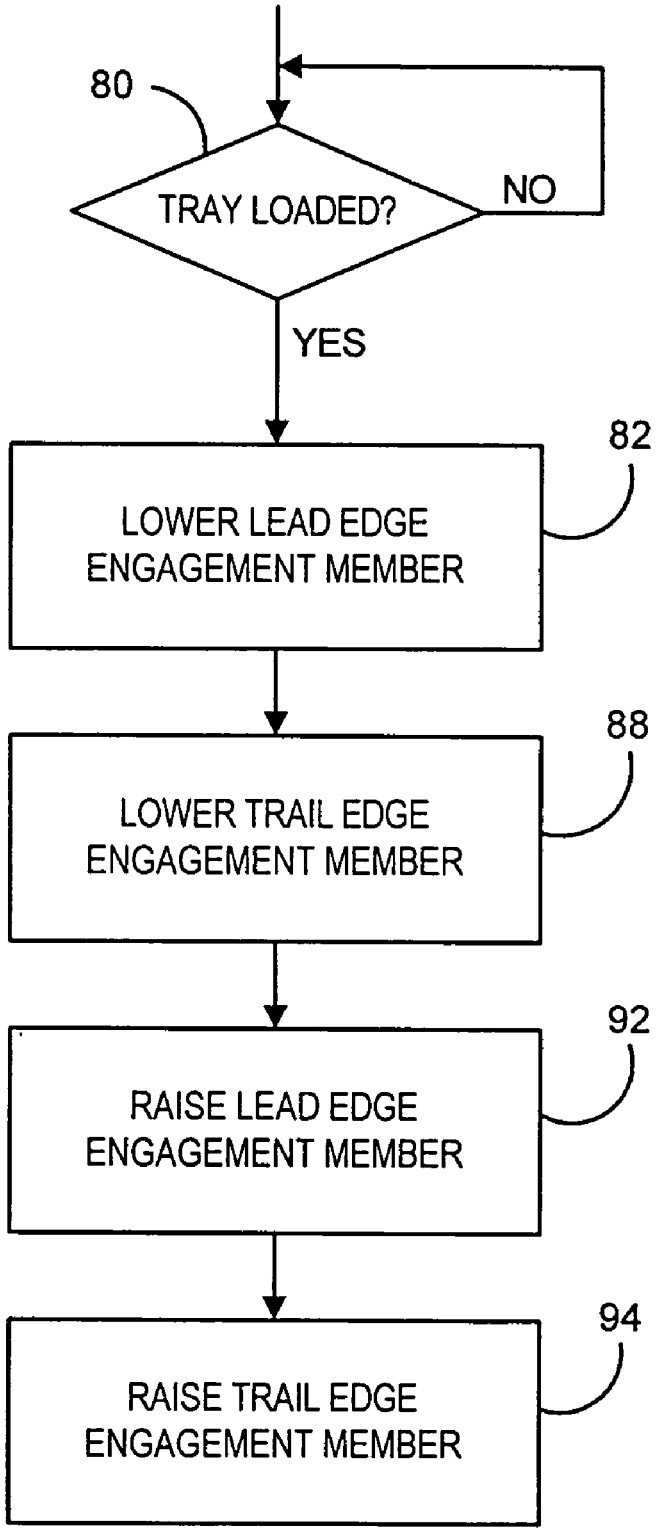
FIG. 7 is a flow chart that illustrates a process performed by the paper stack flexing mechanism of FIG. 2.

FIGS. 3-6 are simplified versions of FIG. 2, showing various stages of operation of the stack flexing mechanism so. FIG. 7 is a flow chart that illustrates a process performed by the stack flexing mechanism under control of the control device 60. Referring initially to FIG. 7, the process begins with a decision step 80 at which it is determined whether the control device 60 has received a sensor signal to indicate loading (or the possibility of loading) of paper into the tray 22*a*. Upon a positive determination at 80, then step 82 follows. At step 82, the control device controls the first actuator 52 (FIG. 2) to lower the first engagement member 50 so that the first engagement member 50 comes into contact with the top sheet of the paper stack 42 at a downstream end 84 (FIG. 3) of the paper stack 42. The first engagement member is lowered sufficiently to apply a downward force that is transmitted through the stack 42 to the hinged portion 32 of the tray 22*a* to pivot the hinged portion 32 downwardly against the biasing force of the bias mechanism 40 (FIG. 2). Thus the first engagement member 50 applies a downward force to the hinged portion 32 via the stack 42. As a result the stack 42 is flexed or bent as illustrated in FIG. 3, so that the downstream end of the stack 42 is lower than the central portion 86 of the stack 42. At the same time, the hinged portion 32 is inclined downwardly away from the hinge point 38 and is lowered to an elevation that is lower than the elevation of the hinge point 38. (As used herein and in the appended claims, the "elevation" of an item will be considered to correspond to the elevation of the lowest portion of an item.) Also, the hinged portion 32 is at an elevation at this stage that is lower than the elevation of the hinged portion when in its home position (FIGS. 2, 5 and 6) in which the hinged portion is in alignment with the balance of the tray.

Figure 4:
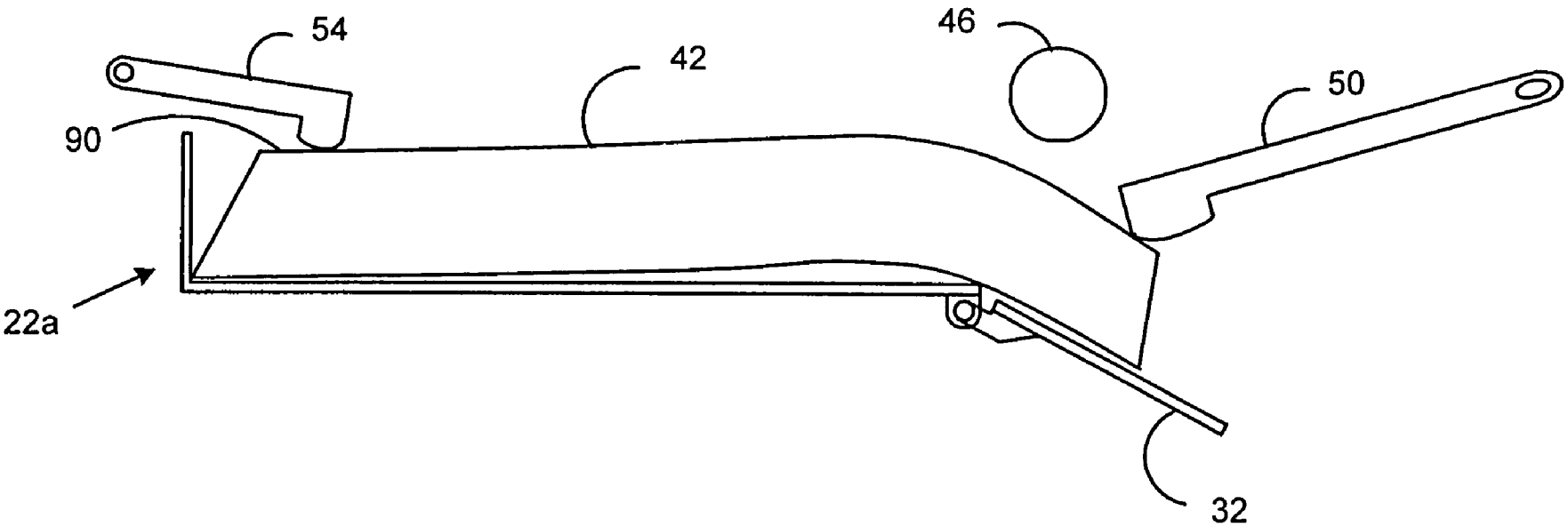

Referring once more to FIG. 7, a step 88 follows step 82. At step 88, with the hinged portion 32 of the tray 22*a* inclined downwardly, and the paper stack 42 flexed as shown in FIG. 3, the control device controls the second actuator 58 (FIG. 2) to lower the second engagement member 54 so that the second engagement member 54 comes into contact with the top sheet of the paper stack 42 at an upstream end 90 (FIG. 4) of the paper stack. The second engagement member is applied to the top sheet of the stack with sufficient force to substantially prevent the sheets of the stack from sliding horizontally relative to each other during a subsequent stage of operation of the mechanism 30. The resulting condition of the tray 22*a*, stack 42 and mechanism 30 is illustrated in FIG. 4.

Referring once more to FIG. 7, a step 92 follows step 88. At step 92, with the second engagement member 54 in its lowered position and applying force downwardly to the upstream end 90 of the paper stack 42, the control device controls the first actuator to raise the first engagement member 50, thereby allowing the biasing mechanism 40 (FIG. 2) to return the hinged portion 32 to its home position as shown in FIG. 5. Because the second actuator effectively (but temporarily) pins the sheets of the paper stack to each other during step 92, the stack 42 assumes the "flared" shape indicated in FIG. 5, with the stack 42 in cross section shaped liked an acute-angle parallelogram or the like with many or all of the sheets of the stack each extending further downstream than the respective downward neighboring sheet.

Next, as indicated at step 94 in FIG. 7, the second engagement member 54 is moved upwardly (under control of the control device 60 and by operation of the second actuator 58) to release the upstream end of the stack 42. The resulting condition of the apparatus is shown in FIG. 6. It will be observed that the stack 42 remains in its flared shape. Sheeting feeding operations may now proceed. The flexing of the paper stack illustrated in FIG. 3 may effectively have broken edge welds between sheets of the paper stack and may have similarly disrupted other bonding between sheets of the stack so that the sheet-to-sheet friction may have been reduced, and the possibility of misfeeds and/or multifeeds may have been reduced. In addition, the flared shape of the stack shown in FIG. 6 may also aid in promoting proper feeding of sheets seriatim from the stack.

The embodiment illustrated in connection with FIGS. 2-7 may be modified in a number of ways, including, e.g., elimination of the second engagement member 54 and associated components.

Figure 8:
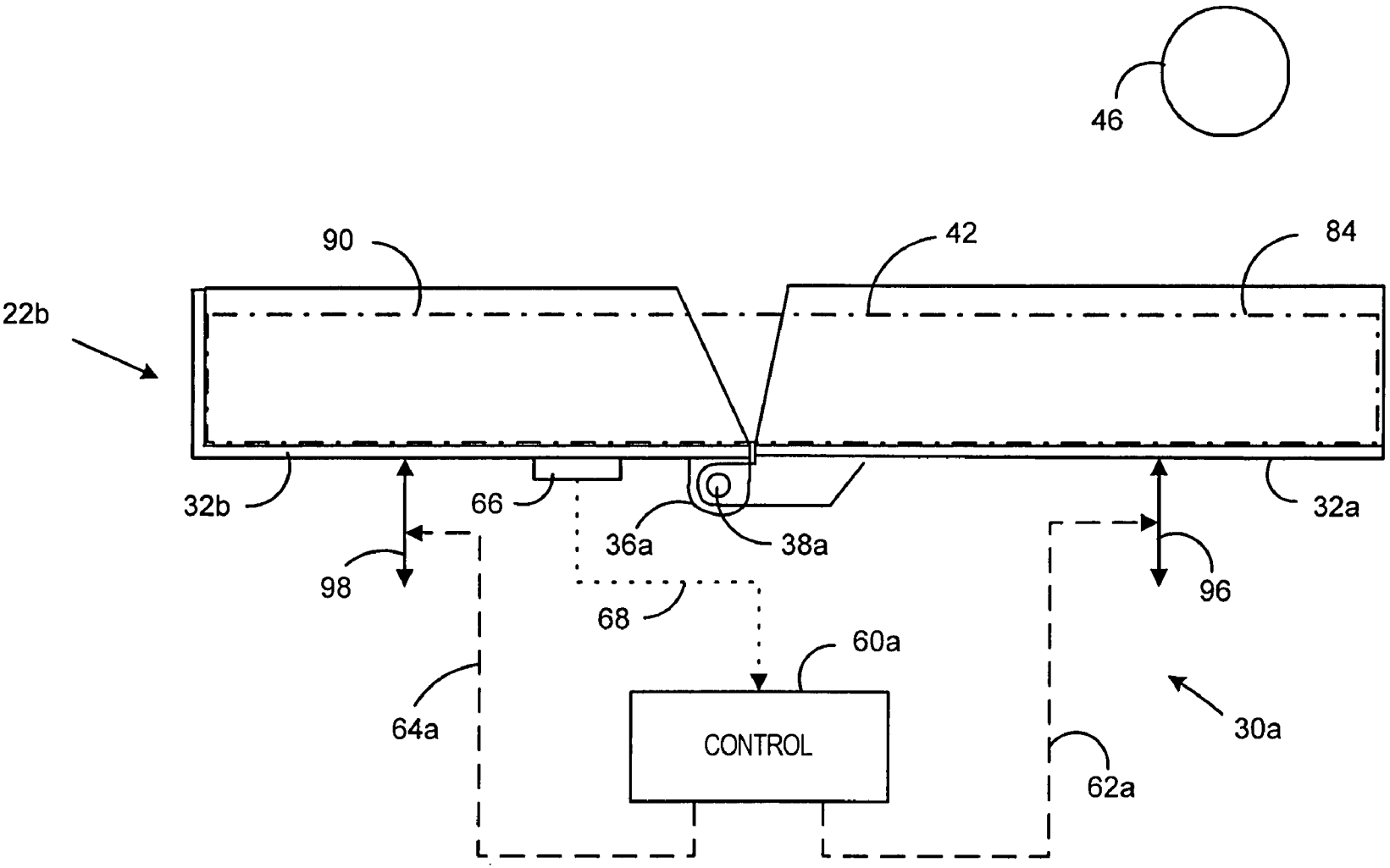
FIG. 8 is a schematic side view of a paper tray and associated paper stack flexing mechanism that are part of the apparatus of FIG. 1 in accordance with some other embodiments of the invention.

FIG. 8 is a schematic side view of a paper tray 22*b* and associated paper stack flexing mechanism 30*a* that may be part of the apparatus 20 in accordance with some other embodiments of the invention. The paper tray 22*b* includes a downstream hinged portion 32*a* for supporting a downstream end 84 of a paper stack 42 (shown with dot-dash lines) and an upstream hinged portion 32*b* for supporting an upstream end 90 of the paper stack 42. The hinged portions 32*a*, 32*b* are pivotable about a shared hinge point 38*a* that coincides with a hinge 36*a*. (A feed roller 46, as discussed above, is also shown in FIG. 8).

The stack flexing mechanism 30*a* shown in FIG. 8 includes a downstream pivot actuator 96 which is operatively coupled to the downstream hinged portion 32*a* of the tray 22*b* and an upstream pivot actuator represented schematically at 98 which is operatively coupled to the upstream hinged portion 32*b* of the tray 22*b*. The downstream pivot actuator represented at 96 is operable to selectively pivot the downstream hinged portion 32*a* of the tray 22*b* up and down, and the upstream pivot actuator 98 is operable to selectively pivot the upstream hinged portion 32*b* of the tray 22*b* up and down. The actuators 96, 98 may, for example, be constituted by respective motor and cam arrangements or by respective solenoids.

A control device 60*a* (again, e.g., an electronic controller, microcontroller or microprocessor) is also included in the stack flexing mechanism 30*a*. The control device 60*a* is operatively coupled, via first and second control signal paths 62*a*, 64*a*, respectively, to the actuators 96, 98 to control operation of the actuators 96, 98. Thus the control device 60*a* is also operatively coupled to the hinged portions 32*a*, 32*b* of tray 22*b* to control movement of the hinged portions 32*a*, 32*b*. (The control signal paths may include suitable buffers, driver circuitry, etc., which are not separately shown.)

A sensor 66, which may be like that described in connection with the embodiment of FIG. 2, is coupled to the control device 60*a* via sensor signal path 68 so that the sensor 66 can indicate to the control device 60*a* occurrence of an event in which paper has, or may have, been loaded into the tray 22*b*.

Figure 9:
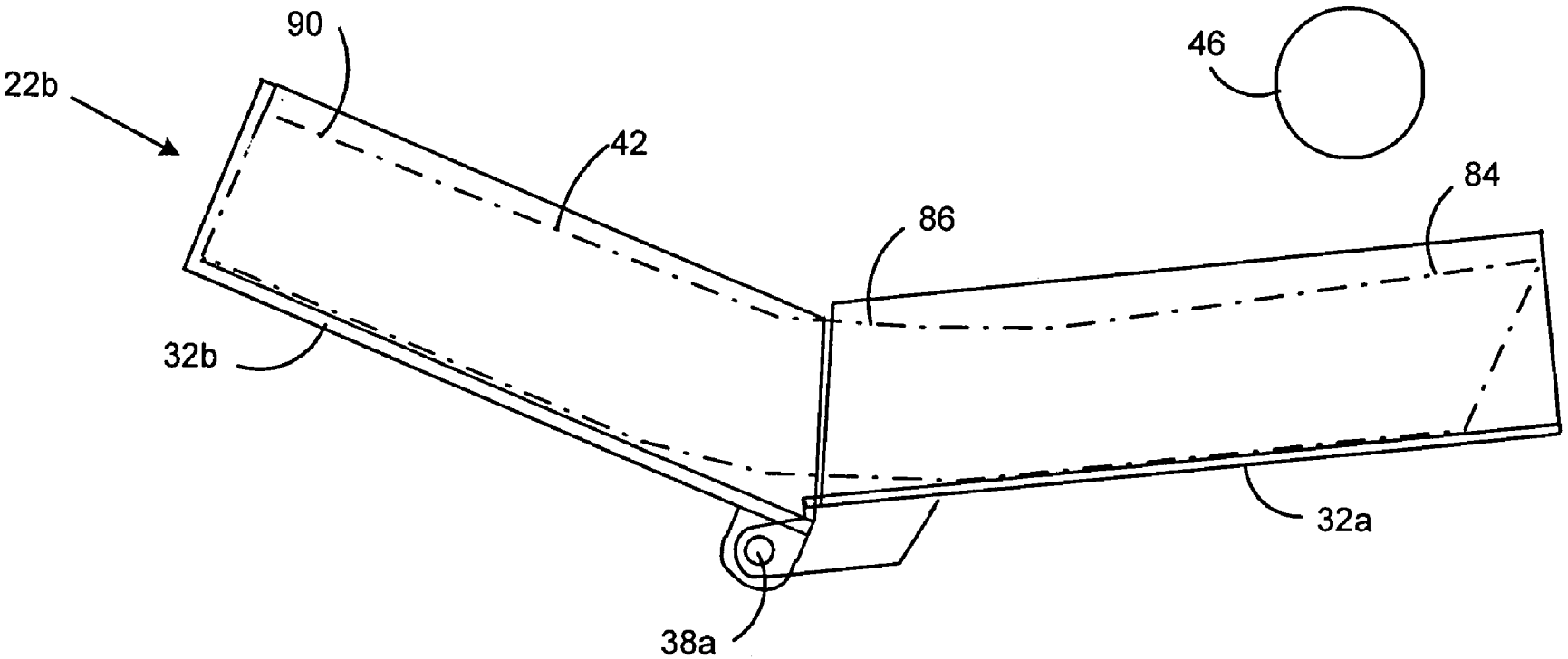
FIGS. 9 and 10 are simplified schematic side views of the paper stack flexing mechanism of FIG. 8, showing various stages of operation thereof.
Figure 10:
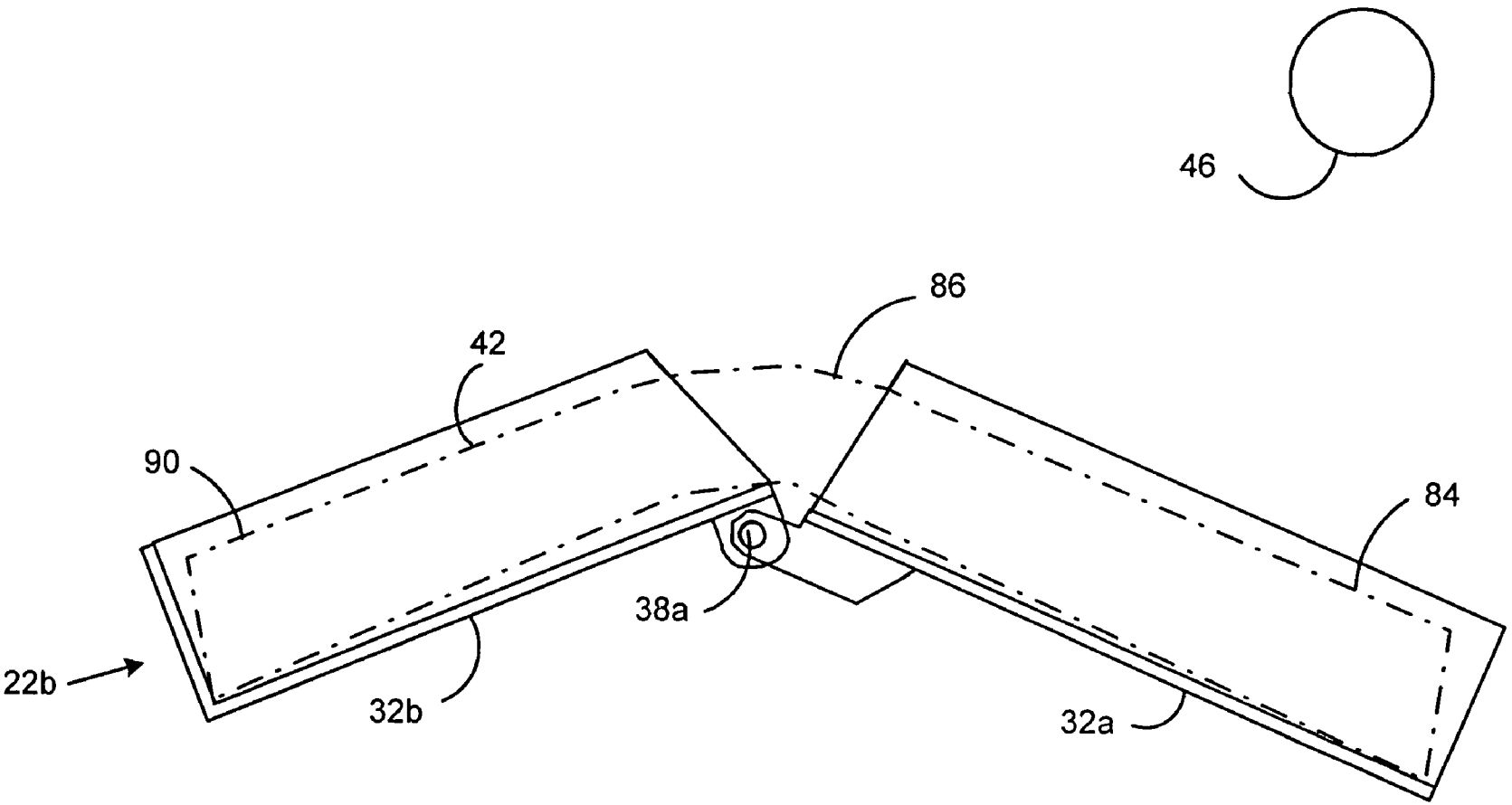
Figure 11:
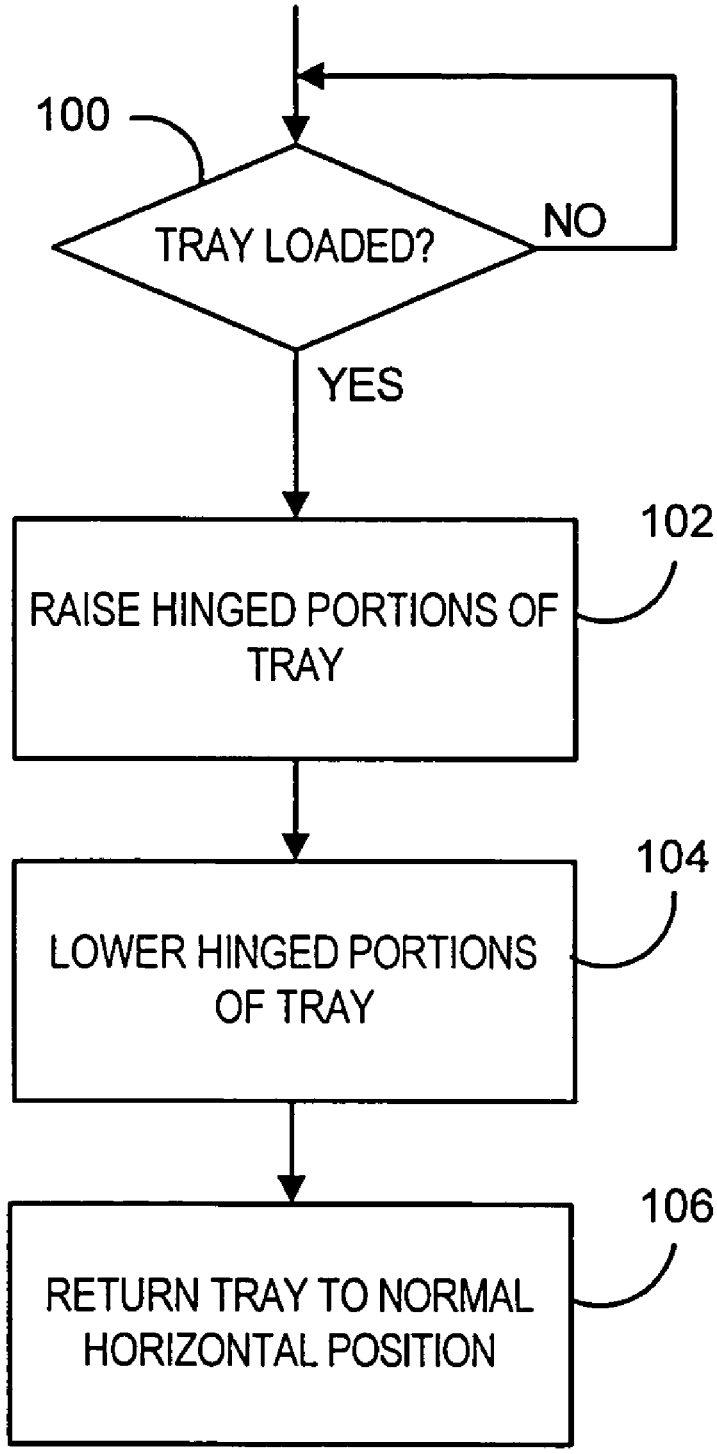
FIG. 11 is a flow chart that illustrates a process performed by the paper stack flexing mechanism of FIG. 8.

FIGS. 9 and 10 are simplified versions of FIG. 8, showing various stages of operation of the stack flexing mechanism 30*a*. FIG. 11 is a flow chart that illustrates a process performed by the stack flexing mechanism 30*a* under control of the control device 60*a*. Referring initially to FIG. 11, the process begins with a decision step 100 at which it is determined whether the control device 60*a* has received a sensor signal to indicate loading (or the possibility of loading) of paper into the tray 22*b*. Upon a positive determination at 100, then step 102 follows. At step 102, the control device 62*a* controls the pivot actuators 96, 98 to upwardly pivot the hinged portions 32*a*, 32*b* of the tray 22*b*. The resulting condition is illustrated in FIG. 9. It will be noted that the ends 84, 90 of the stack 42 are raised above a central portion 86 of the stack 42, and each of the hinged portions 32*a*, 32*b* of the tray 22*b* has an elevation higher than the elevation of the hinge point 38*a* (i.e., both hinged portions are inclined upwardly away from the hinge point). Thus the stack is flexed with its ends upwardly displaced in step 102 relative to the central portion of the stack. Also, the hinged portions are now at elevations that are higher than their elevations when in the home position (FIG. 8) in which the hinged portions are in alignment with each other.

Referring once more to FIG. 11, a step 104 follows step 102. At step 104, the control device controls the pivot actuators 96, 98 to downwardly pivot the hinged portions 32*a*, 32*b* until the hinged portions 32*a*, 32*b* are inclined downwardly by a certain amount from the hinge point 38*a*. The resulting condition is illustrated in FIG. 10. It will be noted that the ends 84, 90 of the stack 42 are lowered below the central portion 86 of stack 42, and each of the hinged portions 32*a*, 32*b* of the tray 22*b* has an elevation lower than the elevation of the hinge point 38*a*. Thus the stack is flexed in step 104 with its ends downwardly displaced relative to the central portion of the stack. Also, the hinged portions are now at elevations that are lower than their elevations when in the home position (FIG. 8) in which the hinged portions are in alignment with each other.

Referring once more to FIG. 11, a step 106 follows step 104. At step 106, the control device controls the pivot actuators 96, 98 to upwardly pivot the hinged portions 32*a*, 32*b* by a sufficient amount to return the hinged portions 32*a*, 32*b* to their home position as shown in FIG. 8. Sheet feeding operations may now proceed. The flexing of the paper stack 42 in the steps 102-106 may effectively have broken edge welds between sheets of the paper stack and may have similarly disrupted other bonding between sheets of the stack so that the sheet-to-sheet friction may have been reduced, and the possibility of misfeeds and/or multifeeds may have been reduced.

It will be noted that in both the upward and downward pivoting of the hinged portions, the two hinged portions are pivoted in opposite angular directions to each other.

The operation of the stack flexing mechanism 30*a* may be modified in a number of respects from that described with respect to FIGS. 9-11. For example, the downward flexing may be performed before rather than after the upward flexing. Alternatively, one of the upward flexing and the downward flexing may be omitted. Moreover, one end of the stack may be flexed (in either or both of the upward and downward flexes) without flexing the other end of the stack. In addition, one end of the stack may be flexed downwardly and then the other end may be flexed downwardly and/or one end of the stack may be flexed upwardly, and then the other end may be flexed downwardly. It will also be appreciated that either one of the hinged portions may be made fixed rather than pivotable, and the associated actuator omitted.

While the drawings and descriptions herein show paper trays arranged in a horizontal orientation, it will be appreciated that the trays may alternatively be mounted at an angle from the horizontal.

According to other possible modifications of the embodiment illustrated in FIGS. 8-11, the hinged portions, each shown as about one-half of the tray, may individually be decreased in length, or one increased and the other decreased, in terms of the extent of the tray constituted by the respective hinged portion. If one or both are decreased in length, the tray may have a fixed middle section and two hinge points (one for each hinged portion) instead of the shared hinge point shown in FIGS. 8-10.

The words "comprise," "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

A number of embodiments of the present invention have been described. Nevertheless, it will be understood that various modifications may be made without departing from the spirit and scope of the invention. Other variations relating to implementation of the functions described herein can also be implemented. Accordingly, other embodiments are within the scope of the following claims.

What is claimed is:

1. A method comprising:

supporting a stack of cut paper sheets on a tray, the tray including a hinged portion; and pivoting the hinged portion of the tray downwardly to move a first portion of the stack of cut paper sheets to an elevation below an elevation of the first portion of the stack of cut paper sheets prior to the pivoting, wherein the pivoting includes contacting a top sheet of the stack of cut paper sheets with a first engagement member and moving the first engagement member downwardly to apply a downward force to the hinged portion of the tray via the stack of cut paper sheets to move the hinged portion of the tray downwardly against an upward force applied by a spring to the hinged portion to flex the stack of cut paper sheets without bringing the stack of cut paper sheets in contact with a feed member.

2. A method according to claim 1, further comprising:

contacting the top sheet of the stack of cut paper sheets with a second engagement member at an opposite portion of the stack from the first engagement member while the hinged portion of the tray is downwardly inclined relative to the initial position of the hinged portion;

allowing the hinged portion to return to the initial position while the second engagement member is in contact with the top sheet of the stack; and moving the second engagement member upwardly away from the stack of cut paper sheets after the hinged portion of the tray has returned to the initial position.

3. A method according to claim 1, wherein the tray includes a first hinged portion and a second hinged portion, a first portion of the stack of cut paper sheets supported on the first hinged portion of the tray, a second portion of the stack supported on the second hinged portion of the tray.

4. A method according to claim 3, wherein the pivoting includes upwardly pivoting the first and second hinged portions of the tray to raise the first and second portions of the stack above their elevations in respective home positions in which the first and second hinged portions are in alignment with each other.

5. A method according to claim 4, wherein the pivoting includes downwardly pivoting the first and second hinged portions of the tray to lower the first and second portions of the stack below their elevations in respective home positions in which the first and second hinged portions are in alignment with each other.

6. A method according to claim 5, wherein the upward pivoting occurs before the downward pivoting.

7. A method according to claim 5, wherein the downward pivoting occurs before the upward pivoting.

8. A method according to claim 3, wherein the pivoting includes downwardly pivoting the first and second hinged portions of the tray to lower the first and second portions of the stack below their elevations in respective home positions in which the first and second hinged portions are in alignment with each other.

9. An apparatus comprising:

a tray for supporting a stack of cut paper sheets, the tray including a hinged portion;

feed means disposed above the tray for selectively feeding sheets seriatim from the stack of cut paper sheets;

stack flexing means for pivoting the hinged portion to flex the stack of cut paper sheets without bringing the stack of cut paper sheets in contact with the feed means, wherein the stack flexing means includes means for downwardly pivoting the hinged portion of the tray, and the stack flexing means includes means for inclining the hinged portion of the tray downwardly from a hinge point of the tray, and the stack flexing means includes a first engagement member disposed above a first end of the tray for selectively contacting a top sheet of the stack of cut paper sheets to apply a downward force to the hinged portion of the tray via the stack of cut paper sheets, bias means for upwardly biasing the hinged portion of the tray;

a second engagement member disposed above a second portion of the tray, the second portion of the tray opposite the first portion of the tray, the second engagement member for selectively contacting the top sheet of the stack of cut paper sheets; and control means operatively coupled to the first and second engagement members to:

move the first engagement member downwardly from a first position to a second position at a time when the second engagement member is not in contact with the top sheet of the stack of cut paper sheets;

move the second engagement member downwardly from a first position to a second position at a time when the first engagement member is in contact with the top sheet of the stack of cut paper sheets;

move the first engagement member upwardly from the second position of the first engagement member to the first position of the first engagement member at a time when the second engagement member is in contact with the top sheet of the stack of cut paper sheets; and move the second engagement member upwardly from the second position of the second engagement member to the first position of the second engagement member at a time when the first engagement member is not in contact with the top sheet of the stack of cut paper sheets.

10. An apparatus according to claim 9, wherein the tray includes a first hinged portion for supporting a first portion of the stack of cut paper sheets and a second hinged portion for supporting a second portion of the stack of cut paper sheets.

11. An apparatus according to claim 10, further comprising:

means for upwardly pivoting the first and second hinged portions to respective elevations that are higher than their elevations when in a home position in which the first and second hinged portions are in alignment with each other.

12. An apparatus according to claim 11, further comprising:

means for downwardly pivoting the first and second hinged portions of the tray to respective elevations that are lower than their elevations when in a home position in which the first and second hinged portions are in alignment with each other.

13. An apparatus according to claim 10, further comprising:

means for downwardly pivoting the first and second hinged portions of the tray to respective elevations that are lower than their elevations when in a home position in which the first and second hinged portions are in alignment with each other.

* * * * *